US005732481A

United States Patent [19]

Farhad

[11] Patent Number: 5,732,481

[45] Date of Patent: Mar. 31, 1998

[54] ADJUSTABLE HEIGHT INSOLE SYSTEM

[75] Inventor: Ben Farhad, Laguna Beach, Calif.

[73] Assignee: Creative Labs, Inc., Boca Raton, Fla.

[21] Appl. No.: 660,866

[22] Filed: Jun. 10, 1996

[51] Int. Cl.[6] ..... A43B 7/16; A43B 13/40; A43B 21/32

[52] U.S. Cl. ..... 36/44; 36/81; 36/37

[58] Field of Search ..... 36/81, 37, 44

[56] References Cited

U.S. PATENT DOCUMENTS

| | | | |
|---|---|---|---|
| 1,242,363 | 10/1917 | Mueller et al. | 36/81 X |
| 2,194,637 | 3/1940 | Burger | 36/81 |
| 2,212,613 | 8/1940 | Messina | 36/81 |
| 2,700,230 | 1/1955 | Beyer | 36/81 |
| 3,124,887 | 3/1964 | Vassar | 36/81 |
| 4,633,598 | 1/1987 | Moronaga et al. | 36/44 |

*Primary Examiner*—Ted Kavanaugh

*Attorney, Agent, or Firm*—Barry L. Haley, Esq.; Harry G. Weissenberger, Esq.

[57] ABSTRACT

A variable-height insole system for a shoe includes a soft-flexible insole and a plurality of heel supporting members in the shoe under the insole. The heel supporting members generally increase in hardness in a downward direction. Selectable lift inserts insertable between the heel supporting members have the greatest hardness.

4 Claims, 2 Drawing Sheets

ADJUSTABLE HEIGHT INSOLE SYSTEM

FIELD OF THE INVENTION

This invention relates to insoles for shoes, and more particularly to a system of insole components which allow the wearer to selectively vary the heel height of the insole.

BACKGROUND OF THE INVENTION

Many persons find it cosmetically desirable to enhance their height when appearing in public. For women, this is easily accomplished in conformity with the dictates of fashion by wearing high-heeled shoes. Men, however, prefer to use height-enhancing methods which are not so readily apparent.

To some degree, men's dress shoes and boots can accomplish some height enhancing by using soles and heels that are thicker than necessary for wear-resistance purposes, but there is a limit to this approach as thickening of the sole and heel eventually makes the shoe unsightly. A better conventional way of solving the problem of non-obvious height enhancement was the provision of an insole with a thick heel. Prior art insoles of this type did, however, have some drawbacks. For one, such insoles were either hard and uncomfortable, or soft and unstable. For another, due to the varying height of the uppers from one type of shoe or boot to another, fixed-height insoles were either high enough to suit the wearer's desires but too high for use in low-profile shoes, or suitable for use in all of the wearer's shoes but not as high as the wearer would have liked.

There consequently was a need in the prior art for a comfortable height-enhancing insole whose height could be adjusted to match various types of footwear.

SUMMARY OF THE INVENTION

The present invention satisfies the above-mentioned need of the prior art by providing a system in which the hardness of the heel-supporting members increases downwardly through several layers, with the actual lift inserts being the hardest. The lift inserts rest on a slightly less hard bottom member which conforms to the shoe and provides arch support. The lift inserts include one or more inserts of varying thickness which are interchangeable to easily provide a desired amount of lift as may be appropriate for a given shoe. The components of the system are so tapered and shaped as to give the foot comfortable yet firm support.

DESCRIPTION OF THE PREFERRED EMBODIMENT

Figure 1:
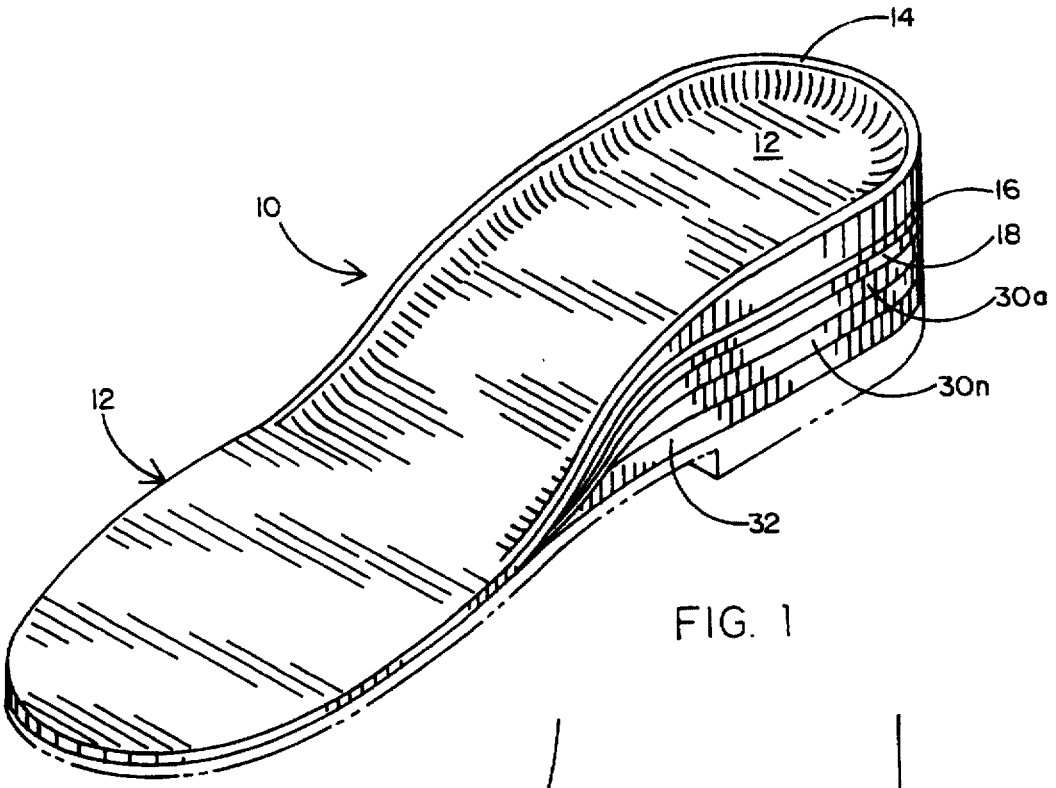
FIG. 1 is a perspective view of the insole system of this invention.
Figure 3:
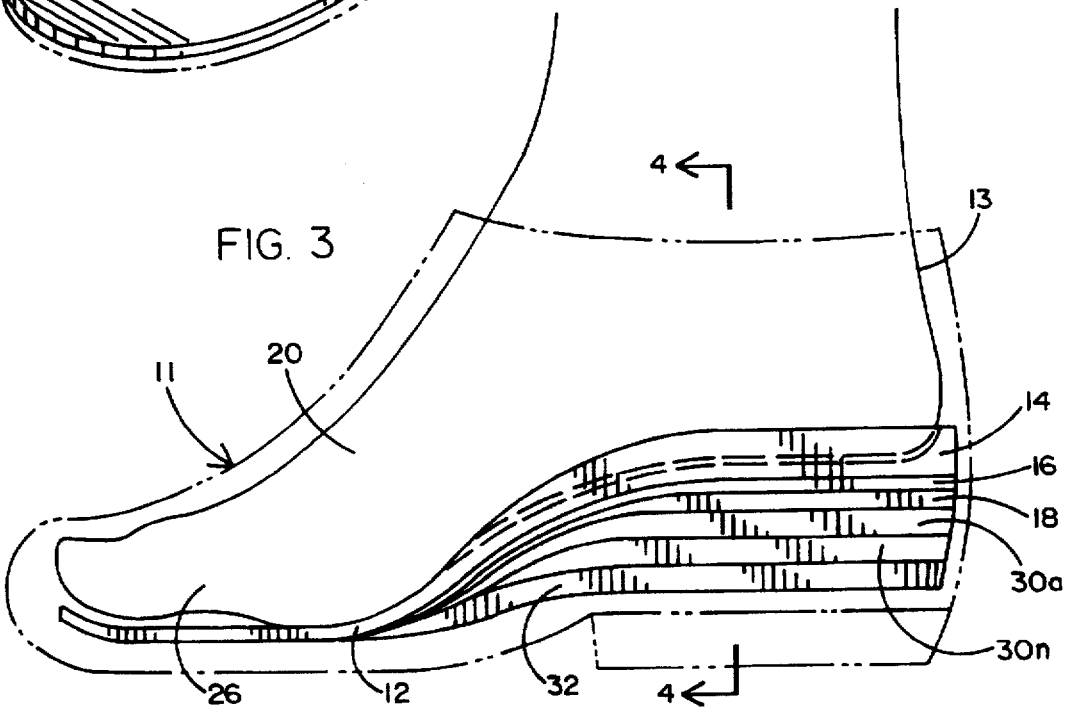
FIG. 3 is a longitudinal vertical section along line 3—3 of FIG. 2 of the inventive insole system in the operational position.
Figure 2:
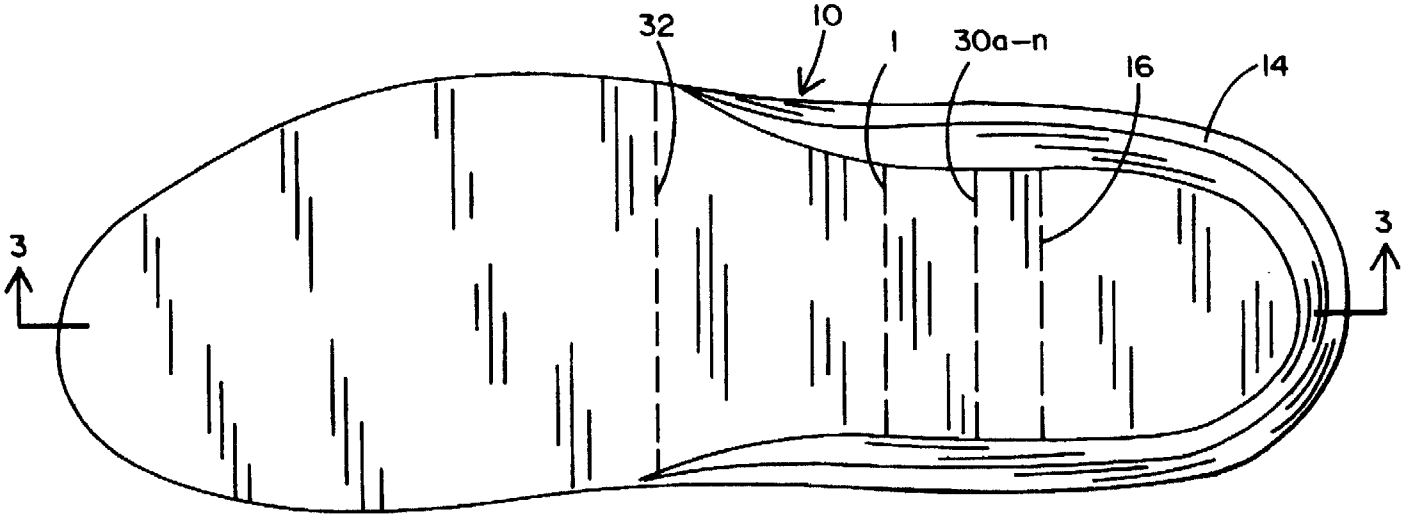
FIG. 2 is a plan view of the system of FIG. 1.
Figure 4:
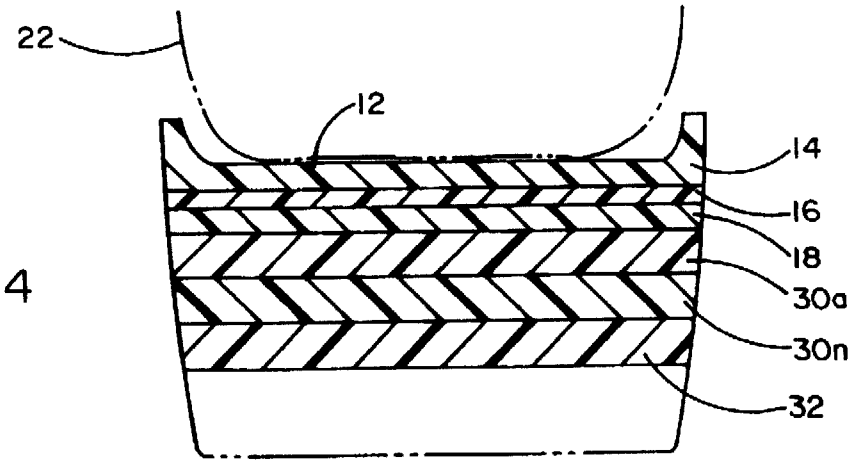
FIG. 4 is a transverse vertical section along line 4—4 of FIG. 3.

The insole system 10 of this invention is best shown in FIG. 1. The system 10 is inserted into a shoe 11 to underlie the wearer's foot 13. The foot 13 rests on a soft, flexible insole 12 which is preferably formed from a light foam material with a longitudinal stiffening layer to prevent it from slipping forward in the shoe. The insole 12 may be covered with cloth to absorb moisture yet impede forward slippage of the foot on the insole 12. Preferably, the edges 14 of the insole 12 are raised around the heel of the foot 13 for further slippage reduction and, centering of the foot 13. The edge 14 is also raised along the arch of the foot 13 to provide some arch support.

A buffer member 16 is preferably permanently attached to the underside of the insole 12 in the region of the heel. The buffer member 16 is preferably formed from a soft rubber which is not compressible like the foam of insole 12, but which yields easily and resiliently to bending stresses. A suitable material for this purpose is high-density ethylene vinyl acetate (EVA) with a Shore A hardness of about 35. The buffer member 16 serves to buffer or cushion the hardness of the heel inserts **30*a*–30*n*** described below.

Immediately below the buffer member 16 is an insertable comfort member 18 also formed from high-density EVA, but with a Shore A hardness on the order of 70. The comfort member 18 is preferably tapered along its forward edge so as to be more resilient and deformable in that area.

Underlying the comfort member 18 are one or more lift inserts **30*a*–30*n* which are the hardest parts of the system 10. An appropriate material for the lift inserts 30*a*–30*n* is high-density EVA with a Shore hardness of about 80 or better. Typically, the number and thickness of the lift inserts 30*a*–30*n*** would be chosen by the user to fit his desires in any particular situation.

Finally, the lift inserts are supported by a bottom member 32 which extends forward substantially farther than the other insertable elements of the system 10 to provide arch support. The bottom member 32 is somewhat softer than the lift inserts **30*a*–*n*, so as to provide firm support yet conform to some degree to the shape of the shoe 11. A suitable material for the bottom member 32** is high-density EVA with a Shore hardness of about 70.

The above-described system provides a walking comfort comparable to the comfort of the shoe 11 alone, yet provides a firm and readily adjustable lift.

It is understood that the exemplary adjustable height insole system described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

I claim:

1. A variable-height insole system for a shoe, comprising:

a) an insole of soft, flexible material;

b) a buffer member of substantially stiffer, rubberlike material fixedly attached to the underside of said insole in the heel area thereof;

c) a comfort member of rubberlike material underlying said buffer member and extending less far forward along said insole than said buffer member, said comfort member being tapered in a forward direction, and the material of said comfort member being substantially harder than the material of said buffer member;

d) a bottom member of a material similar to the material of said comfort member underlying said comfort member and extending forwardly farther than said buffer and comfort members into the arch area of said shoe; and e) at least one lift insert selectively insertable between said comfort member and said bottom member in the heel area of said shoe, said lift inserts being substantially harder than said comfort member and bottom member.

2. The system of claim 1, in which said insole is sufficiently stiff in the longitudinal direction of said shoe to prevent slippage of said insole in said shoe.

3. The system of claim 2, in which said insole includes foam material, and said members are formed from high-density EVA.

4. The system of claim 2, in which said buffer member has a Shore A hardness of substantially 35, said comfort and bottom members have a Shore A hardness of substantially 70, and said lift inserts have a Shore A hardness of at least substantially 80.

* * * * *